US010766507B2

(12) United States Patent
Odden et al.

(10) Patent No.: US 10,766,507 B2
(45) **Date of Patent: *Sep. 8, 2020**

(54) METHOD OF MANUFACTURING A MULTIPLE AXLE RAILCAR HAVING A SPAN BOLSTER

(71) Applicant: KASGRO RAIL CORPORATION, New Castle, PA (US)

(72) Inventors: Jon Odden, Las Vegas, NV (US); Dave Stull, New Castle, PA (US)

(73) Assignee: KASGRO RAIL CORPORATION, New Castle, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/911,880

(22) Filed: Mar. 5, 2018

(65) Prior Publication Data

US 2018/0194374 A1 Jul. 12, 2018

Related U.S. Application Data

(63) Continuation of application No. 14/770,942, filed as application No. PCT/US2015/028569 on Apr. 30, 2015, now Pat. No. 9,908,540.

(60) Provisional application No. 62/074,124, filed on Nov. 3, 2014.

(51) Int. Cl.

| | |
|---|---|
| ***B61F 3/12*** | (2006.01) |
| ***B61D 3/16*** | (2006.01) |
| ***B61F 5/50*** | (2006.01) |
| ***B61F 3/10*** | (2006.01) |

(52) U.S. Cl.
CPC ..... *B61F 3/125* (2013.01); *B61D 3/166* (2013.01); *B61F 3/10* (2013.01); *B61F 5/50* (2013.01)

(58) Field of Classification Search
CPC ... B61F 3/125; B61F 3/10; B61F 5/50; B61D 3/166
See application file for complete search history.

(56) References Cited

U.S. PATENT DOCUMENTS

| | | | | |
|---|---|---|---|---|
| 4,901,649 A * | 2/1990 | Fehrenbach | ..... | B61D 3/16 105/183 |
| 5,802,981 A * | 9/1998 | Kassab | ..... | B61D 3/166 105/157.1 |
| 2006/0060045 A1* | 3/2006 | Koenders | ..... | B23K 7/102 83/13 |
| 2013/0333190 A1* | 12/2013 | Mizumura | ..... | B21D 5/008 29/428 |

* cited by examiner

*Primary Examiner* — Moshe Wilensky
(74) *Attorney, Agent, or Firm* — Michael G. Monyok

(57) ABSTRACT

A method for making a railcar having a span bolster is disclosed. The method involves fabricating and joining the components of the span bolster in a manner such that a camber is built into span bolster. A camber is cut into longitudinal supports that span the length of the bolster. A jig is used to shape top and bottom plates prior to attaching the plates to the longitudinal supports, thus forming the bolster. Truck assemblies are attached to the bolster and a railcar body mounted to the combined unit.

18 Claims, 7 Drawing Sheets

METHOD OF MANUFACTURING A MULTIPLE AXLE RAILCAR HAVING A SPAN BOLSTER

CROSS-REFERENCE TO RELATED APPLICATIONS

The present invention is a Continuation Application of U.S. application Ser. No. 14/770,942 filed on Aug. 27, 2015, which is a national stage filing under 35 U.S.C. § 371 of International Application Number PCT/U.S.2015/028569, filed on Apr. 30, 2015, which claims the benefit of U.S. Provisional Application No. 62/074,124, filed on Nov. 3, 2014, each of which are incorporated by reference herein in their entirety.

STATEMENT REGARDING FEDERALLY SPONSORED RESEARCH

Not applicable.

BACKGROUND OF THE INVENTION

The present invention relates generally to a method of making a railcar. More specifically, the invention relates to a method of manufacturing a multiple axle railcar having cambered span bolsters.

When a railway transports oversized or heavy cargo, it must account for the loading of each axle supporting the weight of the oversized load. To accommodate the excessive load, railways utilize railcars having additional axles compared to standard-capacity railcars. With the load distributed over a greater number of axles, the weight carried by each individual axle is reduced. However, railcar manufacturers must account for the turning performance of the multiple axle railcar, which can be diminished as the number of axles increases. Typically, multiple axle railcars have groups of truck assemblies connected by a span bolster, with a bolster located at each end of the railcar. The span bolster, in turn, attaches to the rail car at a pivot point near the center of the bolster. In this configuration, a multiple axle railcar is able to perform similarly to a standard railcar with a single pivoting truck at each end of the railcar.

An example of such a railcar is a twelve-axle rail vehicle manufactured by Kasgro Rail Corp. and disclosed in U.S. Pat. No. 5,802,981. The twelve-axle railcar has three sets of trucks, or six axles, at each end of the vehicle. The three trucks at each end of the railcar are mounted to a common carrier that distributes the load, otherwise known as a span bolster. The benefit of twelve-axle railcar, in addition to its load carrying capability, is improved turning performance resulting from the fact that one span bolster can pivot independent of the other.

The increased load carrying capability of the twelve-axle railcar, or any other railcar having additional axles, is the result of evenly distributing the weight of the cargo to maintain reasonable wheel and axle loadings. While twelve-axle railcars improve loading, situations can exist where there is a significant variance between each of the axles. For example, the center truck of a three truck set will often have a higher loading than each of the outboard trucks as it is located below the attachment point to the rail car body. Having equal loading on each axle provides numerous benefits, such as improved safety of operation and reduced maintenance costs. It would therefore be advantageous to develop a method of manufacturing a multiple axle railcar having a span bolster in a manner that minimizes manufacturing variances and promotes consistent loading across each axle.

BRIEF SUMMARY OF THE INVENTION

Disclosed is a method of manufacturing a multiple axle railcar having a span bolster capable of evenly distributing a load. The manufacturing method minimizes variances that can be introduced during fabrication or welding operations. The elimination of variances leads to more consistent weight distribution in the completed railcar. Moreover, to improve weight distribution among the multiple axles, the components of the span bolster are fabricated with a camber so that the entire span bolster exhibits a slight arc, with the peak near the point where the bolster attaches to the main body of the railcar. The result of creating a camber is that the span bolster tends to flatten under load, equalizing the load among the axles supported by the bolster. The manufacturing process utilizes a jig, which is adjustable depending on the load rating of the railcar being built, to accurately set the desired camber.

DETAILED DESCRIPTION OF THE INVENTION

Figure 9:
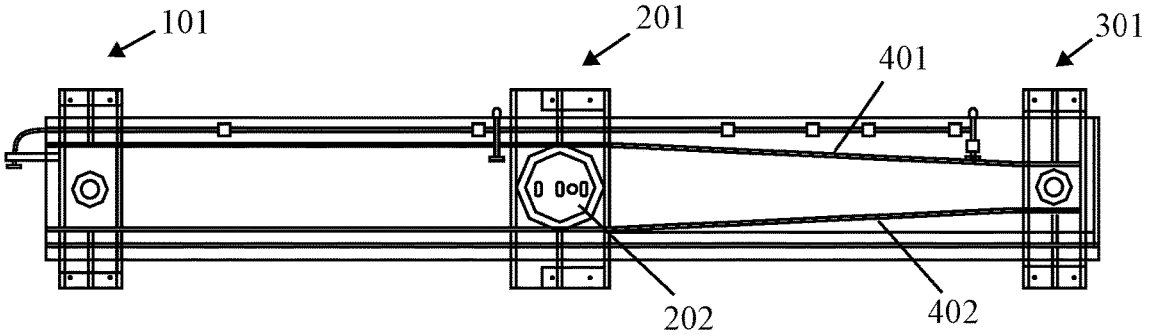
FIG. 9 is an alternative view of the span bolster in which the interior components are shown.
Figure 10:
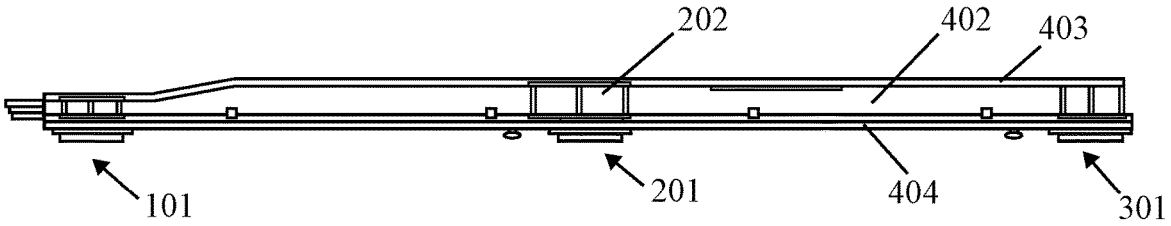
FIG. 10 is a perspective view of the side of the span bolster.

The method of manufacturing a railcar having a cambered span bolster 502 begins with fabrication of the span bolster 502. Construction of the span bolster 502 begins with fabrication of the longitudinal supports 401 and 402, which are shown in FIGS. 9-10. The longitudinal supports 401 and 402, or stringers, are constructed from flat plate steel which varies in thickness depending on the intended application and expected load of the completed railcar. In the preferred embodiment, the supports 401 and 402 are fabricated from 1 inch thick steel. As shown in FIG. 9, when assembled on the bolster 502, longitudinal supports 401 and 402 taper towards the midline of the span bolster 502 near the outboard truck mounting assembly 301. The taper of the longitudinal supports 401 and 402 are created in a press or by other methods known in the art. Alternatively, the longitudinal stringers 401 and 402 can remain substantially linear. The height and length of supports 401 and 402 are also dependent on the intended application.

Figure 8:
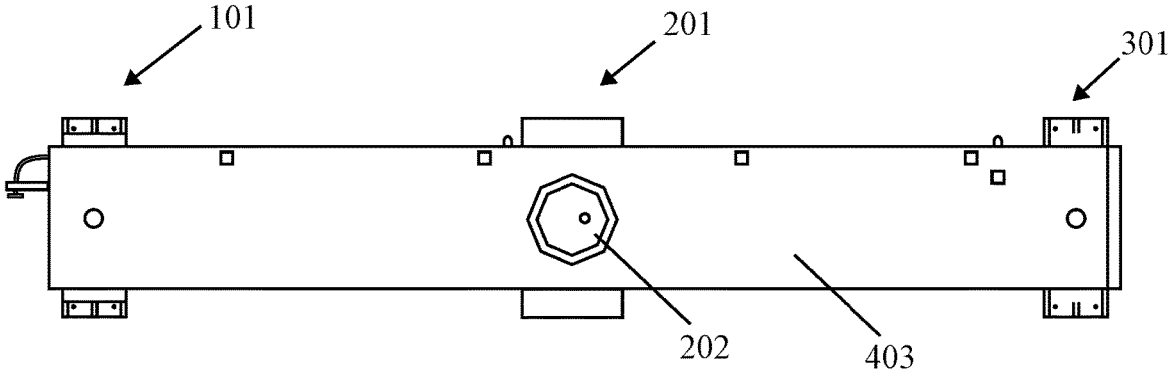
FIG. 8 shows a top view of the span bolster.
Figure 11A:
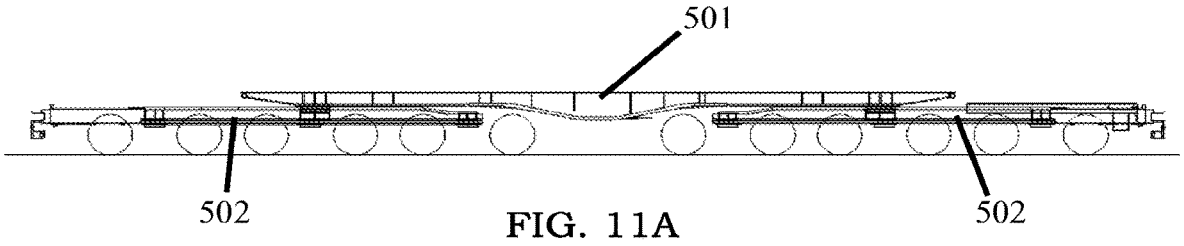
FIG. 11A is perspective view of a railcar with a cambered span bolster at each end of the car.
Figure 11B:
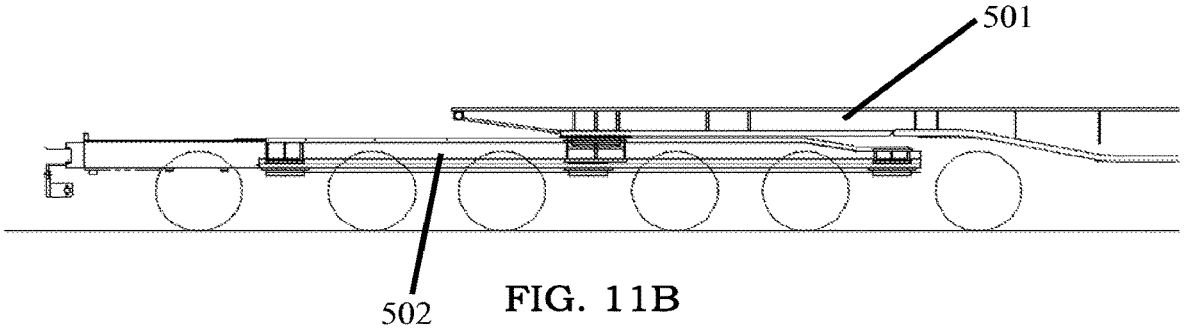
FIGS. 11B-11C are alternate views of the railcar with cambered span bolsters at each end of the car.
Figure 11C:
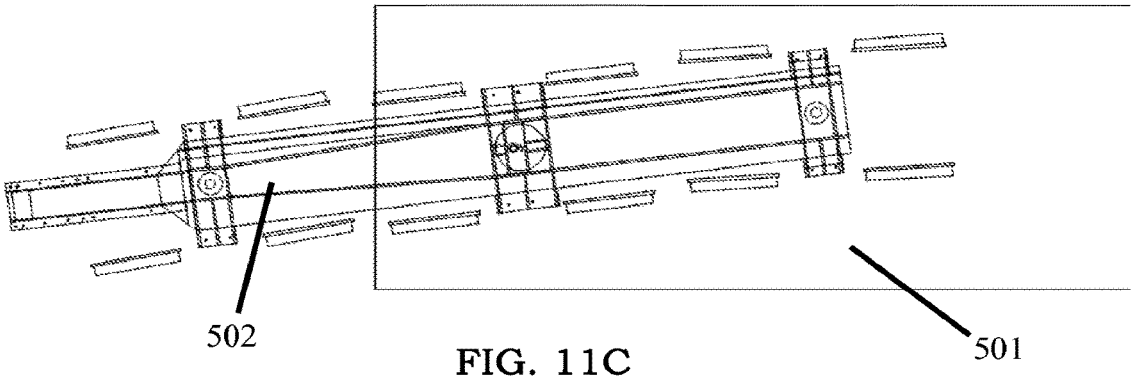

In the preferred embodiment, as shown in FIGS. 8-10, a span bolster 502 carries three truck assemblies. Two separate span bolsters 502, each carrying three truck assemblies, is connected to the main body 501 of the railcar. A depiction of this preferred embodiment is shown in FIG. 11A. FIGS. 11B and 11C show close-ups of alternate views of a completed railcar. While the invention is described in reference to this preferred embodiment, a pair of axles or more can be mounted to each span bolster 502 and any number of span bolsters 502 can be used on the rail car. The specific number of axles, trucks, and bolsters 502 is dependent on the particular application and intended load capacity of the railcar being manufactured.

To evenly distribute the load on each of the six axles, the span bolster 502 is manufactured with a slight camber. More specifically, area of the bolster 502 near its center (the area of the bolster 502 at the receiver 202) is raised compared to the ends of the bolster 502. That is, the span bolster is fabricated with a slight arc which is convex in shape. It is not necessary for the peak of the camber to be located in the center of the bolster 502. Rather, load equalization among the axles is realized when the peak is located near the rail car body receiver 202. Since the load of the railcar is concentrated at the receiver 202, this area of the span bolster 502 experiences the greatest force and, as a result, the greatest deflection from its unloaded shape. As an example, a bolster 502 without a camber would tend to sag under the receiver 202 as the load-induced deflection causes the receiver 202 area to drop below the horizontal plane of the bolster 502.

The amount of camber required for the span bolster 502 is determined based on the specifications of the railcar, such as the length of the bolster 502, the number of axles, trucks, and bolsters 502 being used, the size of material used to create the bolster 502, and the load expected to be carried by the railcar, to name a few. In the preferred embodiment, the camber is ½ inch for a three truck bolster 502 approximately 22 feet long. In this preferred embodiment, the center truck assembly is mounted below the receiver 202 and the two outboard truck assemblies 101 and 301 are mounted towards the end of the bolster 502. As can be seen in FIG. 11A, the truck assemblies 101, 201, and 301 are symmetrically arranged on the bolster 502 to even the load carried by each axle. In alternative embodiments, the truck assemblies can be offset from the receiver 202 or asymmetrical.

Figure 12:
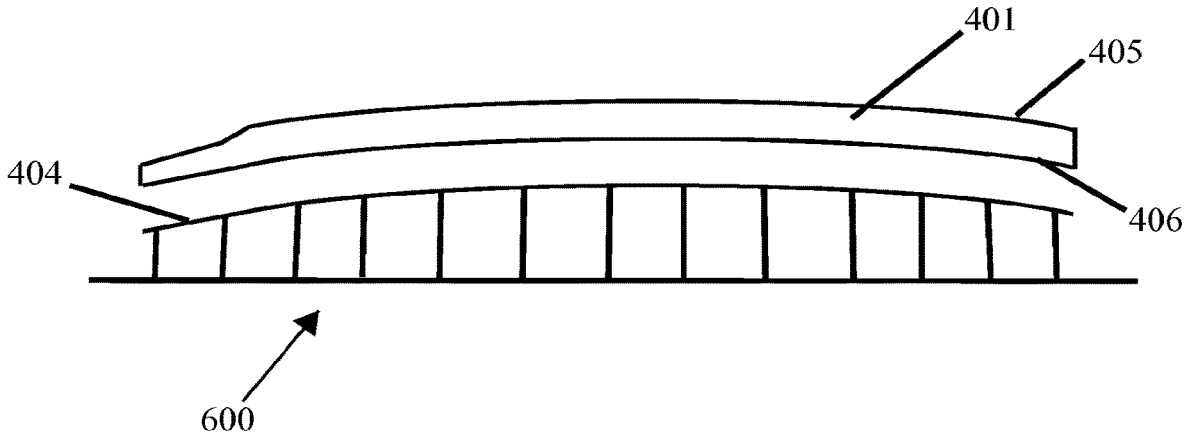
FIG. 12 is a side view of the components of the span bolster at an intermediate stage of the manufacturing process.

During the fabrication of longitudinal supports 401 and 402, the pre-determined camber is cut into the profile of each support 401 and 402. The longitudinal stringers 401 and 402 are beam-like members spanning substantially the length of the bolster 502, with a height from a few to several inches, depending on the load to be carried. As shown in FIG. 12, after the longitudinal stringer 401 is cut, the top surface 405 and bottom surface 406 of the longitudinal stringer 401 is arc shaped. FIG. 12 shows an exaggerated depiction of the camber; otherwise, the camber would not be perceivable in the drawings. In the preferred embodiment, the top surface 405 and bottom surface 406 have the same profile. That is, the peak of the camber is equal for both surfaces 405 and 406. In alternative embodiments, the magnitude of the peak for each surface 405 and 406 is different. Such differences can be required in situations where other equipment being mounted to the bolster 502, for example.

Cutting the stringers 401 and 402 can be accomplished by any typical method, such as using a plasma, waterjet, laser, or oxygen fuel cutter. However, in the preferred embodiment, longitudinal supports 401 and 402, as well as the other components, are cut from flat steel using a computer-controlled cutting machine. As will be appreciated by one skilled in the art, a computer-controlled cutter offers a higher level of accuracy and precision. For example, in the preferred embodiment the tolerance for the peak of the camber is plus ¼ of an inch and the tolerances for other components are plus or minus 1/16 of an inch for lengths and plus or minus ½ of a degree for angles. Over the span of a bolster 502 having a length of 20 feet or more, ¼ of an inch offers very little room for error.

Figure 1:
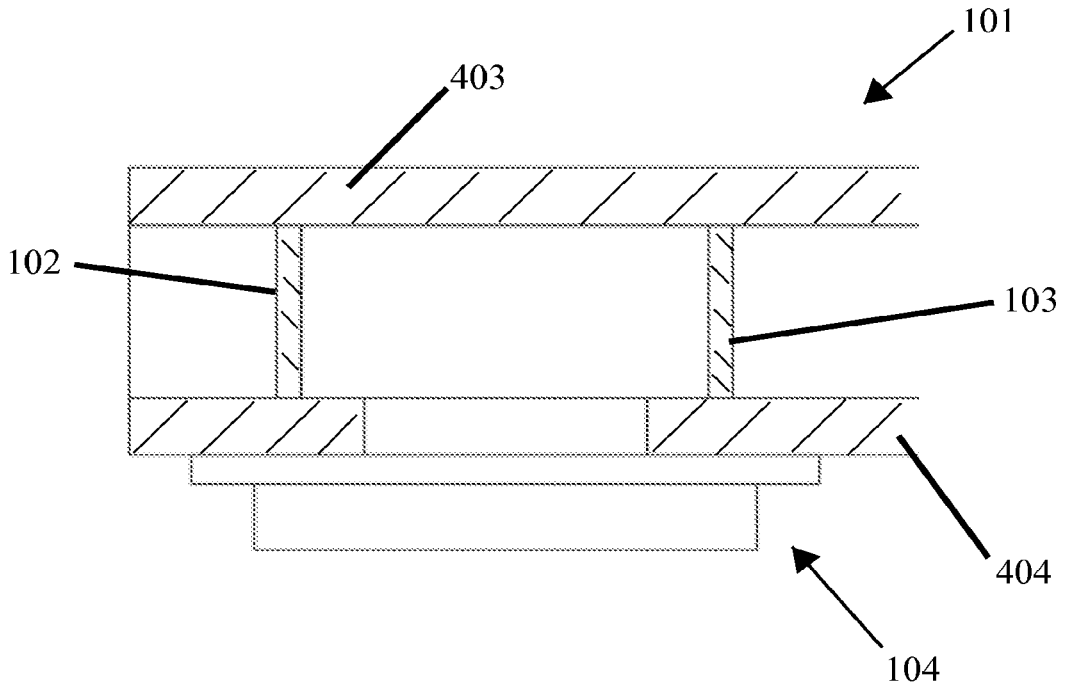
FIG. 1 is a side view of an inboard truck mounting assembly of a span bolster manufactured according to one embodiment of the present invention.
Figure 2:
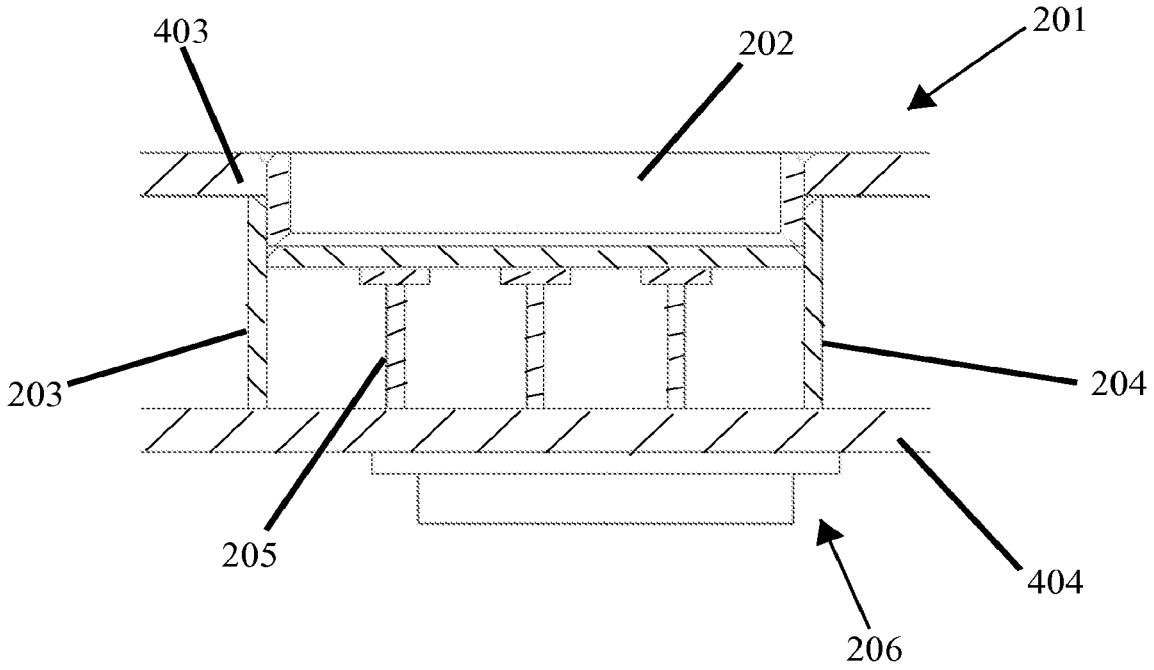
FIG. 2 is a side view of a center truck mounting assembly and receiver of the span bolster.
Figure 3:
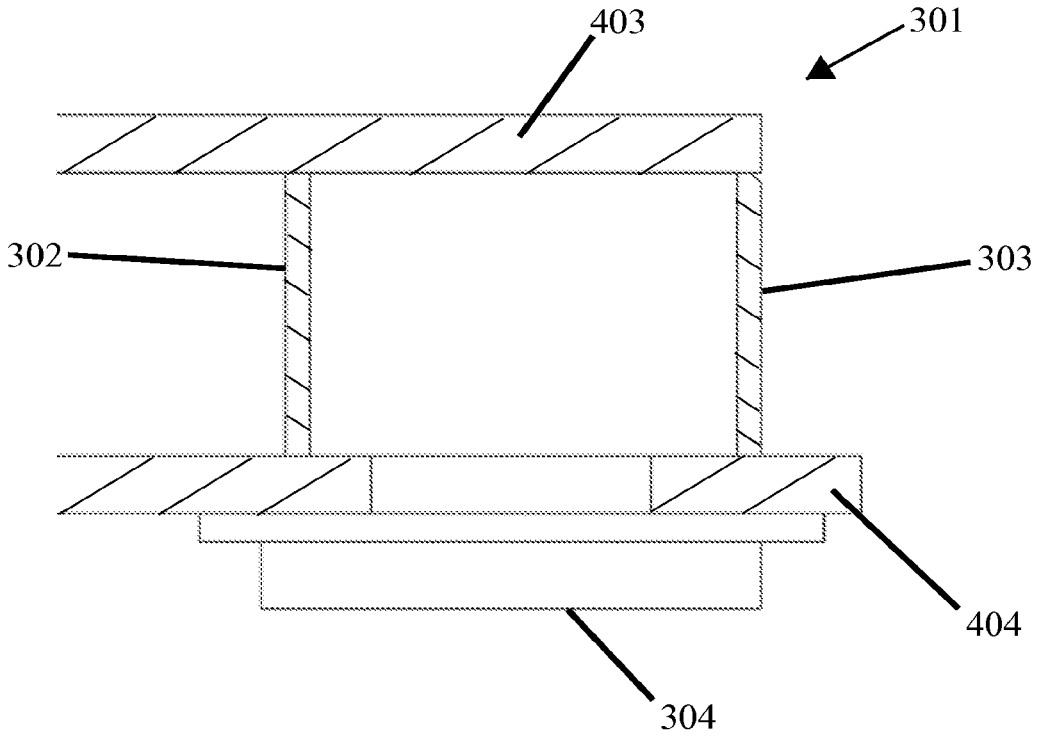
FIG. 3 is a side view of an outboard truck mounting assembly of the span bolster.

Once longitudinal supports 401 and 402 are complete and within tolerances, truck mounting assemblies 101, 201, and 301 are fabricated. A portion of truck mounting assemblies 101, 201 and 301 are welded in between longitudinal supports 401 and 402, where the supports 401 and 402 are arranged in a parallel orientation and run substantially the length of the span bolster 502. In alternative embodiments, a single longitudinal support or additional supports can be used. The remainder of the truck mounting assemblies is positioned below the longitudinal supports 401 and 402. FIGS. 1-3 show a side view of the inboard 101, center 201, and outboard 301 mounting assemblies, respectively. The mounting assemblies 101, 201, and 301 are adapted to connect to an axle truck, such as a SWING MOTION® truck assembly manufactured by Amsted Rail.

As shown in FIG. 8, a receiver 202 is provided and is adapted to attach to the main body 501 of the railcar. In this configuration, which depicts a railcar manufactured according to the preferred embodiment, the weight of load carried by the body 501 of the railcar is placed directly over the center truck, causing a slight sag in the center of the bolster 502. If no camber were present, this point loading would cause the center truck to carry more weight than either of the exterior trucks. As such, the camber is built into the bolster 502 to counteract the load-induced sag. The practical impact of this camber is that the load causes the bolster to flatten, rather than causing it to sag. As previously stated, the camber is determined based on the anticipated load to be carried by the railcar. For example, in one embodiment, the camber is ½ of an inch for a 290 ton span bolster 502.

As shown in FIG. 1, the inboard truck mounting assembly comprises a pair of vertical supports 102 and 103 that span the distance between longitudinal supports 401 and 402. Supports 102 and 103, when attached to longitudinal supports 401 and 402, form a box-like structure around the contact point for the truck assembly. In the preferred embodiment, supports 102 and 103 are welded to longitudinal members 401 and 402 before attaching truck assembly mounting plate 104. Moreover, truck assembly mounting plate 104 is welded during final assembly, after a truck load adjustment is performed.

Figure 7:
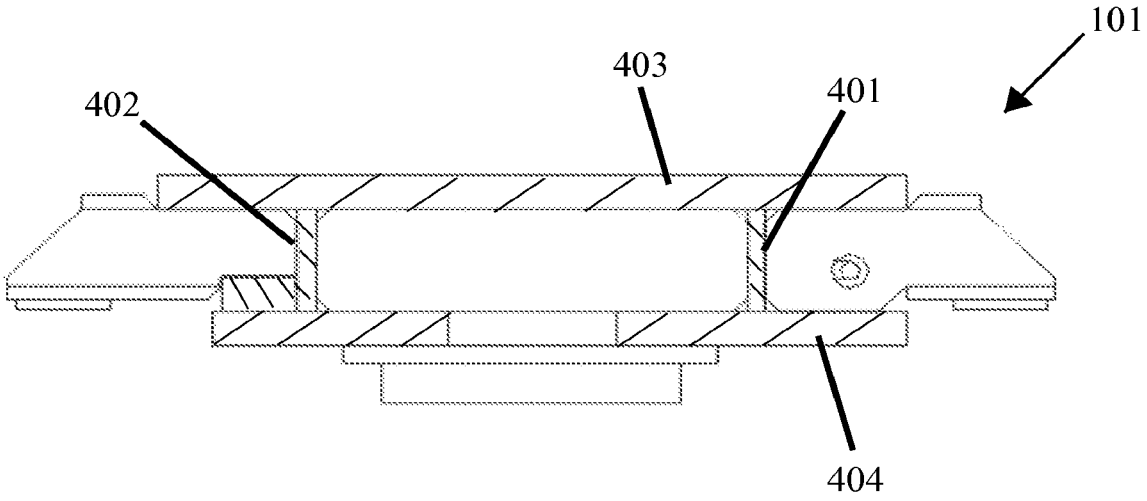
FIG. 7 shows an alternative view of the inboard truck mounting assembly.

Plates 206 and 304, for the center 201 and outboard 301 truck assemblies, are attached in a similar process. As further shown in FIG. 7, the inboard truck mounting assembly 101 extends beyond the longitudinal members 401 and 402 and is substantially the width of the axle that will be installed on the bolster. In addition, as will be later discussed, the truck mounting assembly 101 is welded to top plate 403 and bottom plate 404.

Figure 5:
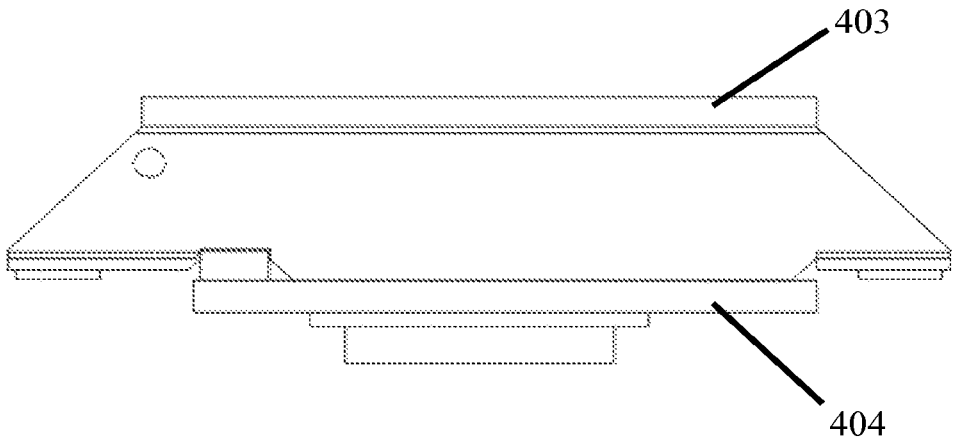
FIG. 5 shows one end of the span bolster as viewed from the outboard truck mounting assembly and along the length of the bolster.
Figure 6:
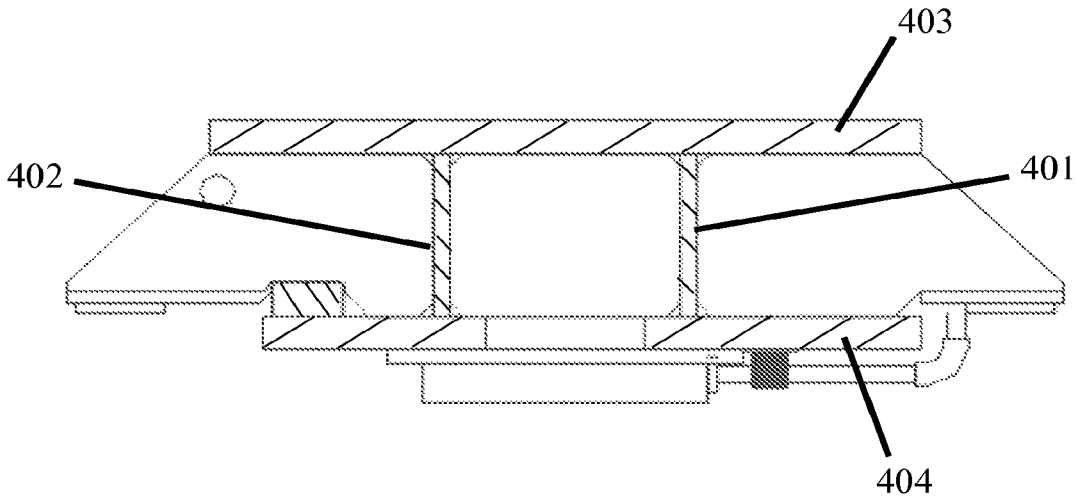
FIG. 6 shows an alternative view of the outboard truck mounting assembly.

The outboard truck mounting assembly is fabricated in a similar manner and is shown in FIG. 3 with supports 302 and 303. The supports are installed before truck assembly mounting plate 304. FIGS. 5-6 shows alternative views of the outboard truck mounting assembly, viewed along the length of the span bolster.

Figure 4:
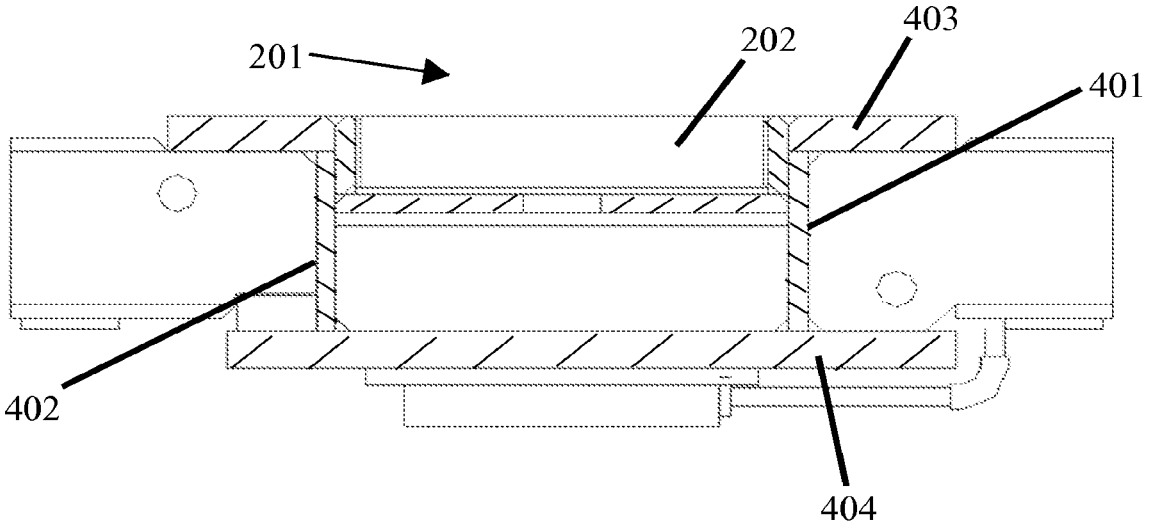
FIG. 4 shows the receiver at the center truck mounting assembly, viewed along the length of the span bolster.

FIG. 2 shows the structure of the center truck mounting assembly 201. As with the exterior assemblies 101 and 301, the center assembly 201 has supports 203 and 204 traversing the width of the space between the longitudinal supports 401 and 402. In the preferred embodiment, center truck mounting assembly further comprises a plurality of supports 205 that are positioned beneath receiver 202. The weight of the railcar body and the load it is carrying is supported directly by receiver 202, so additional bracing provides additional rigidity at this location. FIG. 4 is an alternative view of the center truck mounting assembly 201 and shows the details of receiver 202. As shown in FIG. 4, the receiver is attached to longitudinal supports 401 and 402 and is positioned in an opening of top plate 403. As will be discussed in further detail, receiver 202 is welded to top plate 403 in a subsequent step.

At this stage of the manufacturing process, longitudinal supports 401 and 402 were cut and fabricated. Truck mounting assemblies 101, 201, and 301 were fabricated and attached to supports 401 and 402. The next step of the manufacturing process is to align and weld the combined truck mounting assemblies and longitudinal supports structure to top plate 403 and bottom plate 404.

As previously indicated, the entire bolster is cambered. As such, bottom plate 404 requires a camber to match the arced profile cut into longitudinal supports 401 and 402. Bottom plate 404 can be bent in a press to create the required profile. Alternatively, in the preferred embodiment, bottom plate 404, which is cut from flat stock and still has a flat profile, is placed in a jig 600 that substantially matches the camber of the bottom surface 406 of longitudinal supports 401 and 402. That is, the jig 600 used with the bottom plate 404 will have a convex shape. The jig 600 has an advantage of keeping the parts in proper alignment during the welding process, which can cause distortion as the metal heats and cools.

The jig 600 comprises a series of parallel flat bars that span the width of bottom plate 404. The bars are constructed of plate steel and are spaced every several inches to every few feet along the length of the bolster. Stated differently, a first bar is located near the inboard truck mounting assembly 101, a second bar is placed parallel to the first bar a few inches away from the first bar, and additional bars are positioned along the length to the outboard truck mounting assembly 301. Alternatively, other supports that can support the weight of the components can be used, such as pipes or monolithic forms. In the preferred embodiment, the parallel bars have adjustable heights so that the camber can be adjusted depending on the load rating of the railcar. For a camber of ½ of an inch, the center bar, which aligns with the center truck mounting assembly 201, has a height of ½ inch greater than the bars on each end of the jig 600. Intervening bars are have a height lower than the center bar, but greater than the end bar. With a jig 600 of this configuration, the amount of camber and the degree of taper from the peak to the ends can be adjusted prior to placing the bottom plate 404 in the jig 600.

After the jig 600 is set for the appropriate camber and bottom plate 404 is placed in the jig 600, the combined longitudinal support and truck assembly component is placed on top of bottom plate 404, which is resting on the jig 600. The weight of the steel begins deforming the bottom plate 404 to the shape of the jig 600. However, additional force is often required and can be supplied by additional weight, a press, clamps, or other means. In the preferred embodiment, the jig 600 rests on a table and several chains are positioned across the width of the table. Each chain is anchored to the floor or to the table and a winch tensions the chain. Thus, the chain supplies a downward force to the components. Alternatively, to equalize the pressure of the chain on the components, pulleys are placed at the terminal ends of a bar and the bar is placed across the component. By placing separate chains and winches at several locations along the length of the bolster, the bottom plate 404 is forced into contact with each bar of the jig 600. After the chains are tensioned, the parts are checked for proper positioning. If aligned correctly, the bottom surfaces 406 of longitudinal support 401 and 402, which already have been supplied with the truck mounting assembly components, is welded to bottom plate 404. If the alignment is not correct, shims can be used to force the components into the correct alignment. Typically, welding components together causes heat stress that can lead to warping and other deformations in the components being welded together. However, the method of the present invention alleviates this concern as the components are forced into position and held there until the welding process is complete. By using this method, tight tolerances can be achieved.

A second jig with the same structure as the first jig 600 but having a concave shape is prepared in a similar manner. Alternatively, the components can be removed from the first jig 600 and the bars adjusted to a concave shape, wherein the bar aligned with the center truck mounting assembly 201 has a height of ½ inch lower than the bars at the end of the jig. Top plate 403 is placed on the concave-shaped jig. Next, the previously assembled component is inverted and placed on top of top plate 403. Stated differently, the entire assembly is placed in the jig upside-down, since the longitudinal support structure is attached to the underside of the top plate 403, with the top surface 405 of the longitudinal members 401 and 402 welded to the underside of the top plate 403. As a result, the top side of top plate 403 must rest against the jig.

A clamping process using chains and winches is again performed. Once the parts are aligned within the tolerances, the top plate 403 is welded to the previously assembly components. The top plate 403 and bottom plate 404 are welded to both the longitudinal supports 401 and 402 as well as each individual truck mounting assembly 101, 201, and 301. Additionally, receiver 202 is welded around the circumference of an opening in top plate 403. Alternatively, the sequence in which the top plate 403 and bottom plate 404 are attached to the longitudinal supports can be reversed.

Prior to final assembly and depending on the application, weld inspections may be performed by a mag particle or a dye penetrant test. Inspection of the weld between the longitudinal supports 401 and 402 to top plate 403 and bottom plate 404 are most critical.

FIGS. 8 and 10 show the completed bolster. FIG. 9 shows the internal structure of the assembled bolster, with longitudinal members 401 and 402 running the length of the bolster. At this stage, any additional components required for the railcar, such as wiring or braking components, can be attached to the bolster. To complete final assembly of a twelve-axle rail car, a pair of bolsters 502 are positioned beneath a railcar body 501 and attached at receiver 202 on each respective span bolster. Truck assemblies containing two axles each are attached to each truck mounting assembly 101, 201, and 301 on each of the bolsters 502.

While the method has been described in detail and with reference to specific embodiments and examples thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A method for manufacturing a railcar having a span bolster, comprising:

fabricating a span bolster having a camber;

creating an attachment point for a railcar body at a raised peak of the camber in the span bolster, wherein the raised peak is positioned above a horizontal plane of the span bolster to counteract load-induced sag from the weight of the railcar body;

attaching at least two trucks to the span bolster; and mounting the railcar body to the span bolster.

2. The method of claim 1, wherein fabricating a span bolster having a camber comprises:

cutting a longitudinal stringer in an arc shape;

forcing a top plate against a first jig to elastically deform the top plate, wherein a contour of the first jig is shaped to substantially match a profile of a top surface of the longitudinal stringer;

attaching the top plate to the top surface of the longitudinal stringer, wherein the top plate is retained in the first jig under force until attached to the longitudinal stringer;

forcing a bottom plate against a second jig to elastically deform the bottom plate, wherein a contour of the second jig is shaped to substantially match a profile of a bottom surface of the longitudinal stringer; and attaching the bottom plate to the bottom surface of the longitudinal stringer, wherein the bottom plate is retained in the second jig under force until attached to the longitudinal stringer.

3. The method of claim 2, wherein forcing the top plate comprises:

placing a topside of the top plate against the first jig, wherein the first jig is concave;

placing the longitudinal stringer on an underside of the top plate;

applying a downward force on the longitudinal stringer, wherein the longitudinal stringer transfers the force onto the top plate, thereby pressing the top plate to conform to the contour of the first jig.

4. The method of claim 2, wherein forcing the bottom plate comprises:

placing an underside of the bottom plate against the second jig, wherein the second jig is convex;

placing the longitudinal stringer on a top side of the bottom plate;

applying a downward force on the longitudinal stringer, wherein the longitudinal stringer transfers the force onto the bottom plate, thereby pressing the bottom plate to conform to the contour of the second jig.

5. The method of claim 2, wherein the top plate is substantially flat prior to forcing the top plate against a first jig, wherein the bottom plate is substantially flat prior to forcing the bottom plate against a second jig.

6. The method of claim 1, wherein the raised peak is located at the midpoint of the span bolster.

7. The method of claim 1, wherein the at least two trucks are spaced symmetrically about the raised peak.

8. The method of claim 1, further comprising: determining the camber based on an expected load carrying capacity of the railcar.

9. The method of claim 2, wherein cutting the longitudinal stringer in an arc shape comprises:

using a computer-numerically-controller device to cut the arc shape of the longitudinal stringer.

10. The method of claim 1, wherein attaching the at least two truck assemblies to the span bolster comprises:

performing a truck load adjustment calibration; and attaching the at least two truck assemblies based on the results of the truck load adjustment calibration.

11. A method of manufacturing a span bolster having a camber, comprising:

providing a top plate, wherein the top plate is substantially flat;

providing a bottom plate, wherein the bottom plate is substantially flat;

providing a longitudinal support structure in an arc shape;

positioning the top plate against a first jig, wherein a profile of the first jig matches the arc shape of the longitudinal stringer;

forcing the top plate into the first jig, wherein the top plate is deformed to match the profile of the first jig;

attaching the top plate to a top side of the longitudinal support;

positioning the bottom plate against a second jig, wherein a profile of the second jig matches the arc shape of the longitudinal stringer;

forcing the bottom plate into the second jig, wherein the bottom plate is deformed to match the profile of the second jig;

attaching the bottom plate to the longitudinal support; and creating an attachment point at a raised peak of the camber in the span bolster, wherein the raised peak is positioned above a horizontal plane of the span bolster to counteract load-induced sag.

12. The method of claim 11, wherein the first jig is concave, wherein the second jig is convex.

13. The method of claim 12, wherein at least one of the profile of the first jig and the profile of the second jig is adjustable.

14. The method of claim 13, further comprising:

determining an expected load capacity of the span bolster;

calculating the camber required for the expected load capacity; and adjusting at least one of the profile of the first jig and the profile of the second jig to set the camber.

15. The method of claim 11, wherein the profile of the first jig is shaped differently from the profile of the second jig.

16. The method of claim 11, wherein providing the longitudinal support structure in an arc shape comprises:

cutting a first longitudinal stringer;

cutting a second longitudinal stringer in substantially the same shape as the first longitudinal stringer;

arranging the first longitudinal stringer and second longitudinal stringer in a parallel orientation; and partially mounting at least a pair of truck mounting assemblies between the first longitudinal stringer and the second longitudinal stringer.

17. The method of claim 1, wherein fabricating a span bolster having a camber comprises:

cutting a longitudinal stringer in an arc shape;

attaching a top plate to a top surface of the longitudinal stringer;

attaching a bottom plate to a bottom surface of the longitudinal stringer, wherein the top plate and the bottom plate have a matching camber profile.

18. The method of claim 1, wherein the camber is created along the length of the span bolster.

* * * * *